US006253425B1

(12) United States Patent
Matsushima et al.

(10) Patent No.: US 6,253,425 B1
(45) Date of Patent: Jul. 3, 2001

(54) SLIDE FASTENER

(75) Inventors: Hideyuki Matsushima; Takayuki Hasegawa, both of Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/375,192

(22) Filed: Aug. 16, 1999

(30) Foreign Application Priority Data

Aug. 28, 1998 (JP) ..... 10-243179

(51) Int. Cl.[7] ..... A44B 19/34; G09F 13/16

(52) U.S. Cl. ..... 24/399; 24/381; 24/389; 24/400; 350/105

(58) Field of Search ..... 24/399, 400, 395, 24/381, 587

(56) References Cited

U.S. PATENT DOCUMENTS 3,154,872 * 11/1964 Nordgren ..... 40/135
4,075,049 * 2/1978 Wood ..... 156/220
4,496,618 * 1/1985 Pernicano ..... 350/105
4,630,891 * 12/1986 Li ..... 350/105
4,922,585 * 5/1990 Suzuki et al. ..... 24/381
5,728,448 * 3/1998 Okeya et al. ..... 428/193
5,771,546 * 6/1998 Minato ..... 24/429

* cited by examiner

*Primary Examiner*—Victor N. Sakran
(74) *Attorney, Agent, or Firm*—Finnegan, Henderson, Farabow, Garrett & Dunner, L.L.P.

(57) ABSTRACT

The present invention provides a slide fastener having a three-dimensional reflecting function on faces of fastener tapes by simple structure and means. Each of reflective tapes is provided separately from a fastener tape and has a band-shaped attaching portion, a bulging edge portion integrally formed on a longitudinal edge portion of the attaching portion, and a reflective portion formed by providing a retroreflective film or the like on the bulging edge portion. Each the reflective tape is attached to the fastener tape beside fastener elements such that at least a distance corresponding to a thickness of a flange of a slider is maintained between the bulging edge portion and the fastener elements, the reflective portion of the bulging edge portion appears and protrudes from a surface of the fastener tape, and that the bulging edge portion can swing. Each the reflective portion is not damaged by a sliding movement of the slider and can exhibit a three-dimensional reflecting function.

10 Claims, 6 Drawing Sheets

SLIDE FASTENER

BACKGROUND OF THE INVENTION

1. Field of the Invention

The present invention relates to a slide fastener comprising reflective tapes as separate bodies which have a certain degree of rigidity and have bulging edge portions with reflective portions on their surfaces, the reflective tapes being attached along fastener elements so as to form reflective portions on surfaces beside of the fastener elements of the slide fastener at constant intervals. The slide fastener reflects light when illuminated at night such that a presence of the fastener can be clearly indicated and recognized.

2. Description of the Related Art

There is a conventional slide fastener as disclosed in Japanese Utility Model Laid-open Publication No. 63-135390, wherein a retroreflective sheet is adhered or bonded to a portion of a surface of each fastener tape of the slide fastener.

There is also a tape for a slide fastener as disclosed in Taiwan Patent No. 284984, wherein a retroreflective tape is woven into a woven fastener tape to appear on front and rear surfaces of the fastener tape in a longitudinal direction by holding the retroreflective tape by every several wefts such that the retroreflective tape is adjacent to a fastener element attaching portion.

Furthermore, there is a reflective tape as disclosed in Japanese Utility Model Laid-open Publication No. 4-7689, wherein one longitudinal edge of a tape as a reflective tape is hollow-woven and a single yarn formed by finely slitting a reflective film into yarns is woven into the hollow-woven portion to form a reflective tape.

There is also a slide fastener as disclosed in Japanese Utility Model Laid-open Publication No. 64-39024, wherein an elastic band having a bulging portion at an edge portion is sewn along one longitudinal edge of the band on a rear face of a fastener tape such that the bulging portion is positioned on a fastener element side and the bulging portions come into contact with each other when a fastener is closed.

In the tape for the slide fastener according to the first example of the foregoing prior art, because the retroreflective sheet is attached to the surface of the fastener tape by adhering means or bonding means, the retroreflective sheet may peel off the fastener tape in use of the slide fastener and there is uncertainty about if the tape for the slide fastener can effectively and properly exhibit its reflective function for the long term. Moreover, because a retroreflective portion is flat, a three-dimensional reflecting function can not be expected.

In the tape for the slide fastener according to the second example, the retroreflective tape does not peel off the fastener tape. However, because the fastener tape is a woven tape and the retroreflective tape is woven into by wefts such that the tape is adjacent to fastener elements, the slider slides on a face of the retroreflective tape in opening and closing operations by the slider. Therefore, the retroreflective tape may suffer fretting damage and has a problem with its durability. Moreover, a three-dimensional reflecting function can not be expected.

In the reflective tape according to the third example, because both the foundation woven portion and hollow-woven portion are flexible and are easily dented by pressure, the reflective tape is suitable as a beaded edge for clothes, bags, or the like. However, because the hollow-woven portion does not have rigidity, the three-dimensional reflective function can not be expected when the reflective tape is used with the slide fastener in an opening portion of the clothes, bags, or the like.

Next, because the band which has the bulging portion at the edge portion thereof and is used in the slide fastener according to the fourth example is disposed not on a front side but on an inner side, i.e., a rear face of an opening edge of a bag or the like, it is impossible to dispose the band such that the bulging portion appears on the front face of the fastener tape to exhibit ornamental effects of the slide fastener, i.e., a three-dimensional reflecting function.

SUMMARY OF THE INVENTION

The present invention has been developed with the above-described problems in view, and it is a main object of the invention to provide a slide fastener formed by attaching reflective tapes to surfaces of fastener tapes, the reflective tapes each having at an end portion thereof a reflective portion. The slide fastener has a three-dimensional reflecting function on surfaces of the fastener tapes by simple structure and means, can indicate its presence by properly reflecting light when illuminated at night, and has favorable appearance.

It is an object of the invention to provide a slide fastener which can further properly exhibit the three-dimensional reflecting function by specifying a shape and a disposing form of a bulging edge portion of each reflective tape, the bulging edge portion having a reflecting function.

It is an object of the invention to provide a slide fastener having an excellent reflecting function by simple structure and material by specifying forms of the attaching portion and the bulging edge portion of each reflective tape and by employing a reflective film in the reflective portion of the bulging edge portion.

It is an object of the invention to provide a slide fastener having an excellent reflecting function by simple material by using a retroreflective film or a light storage reflective film as the reflective film used in the reflective portion.

It is an object of the invention to provide a slide fastener having a further excellent reflecting function by simple structure and material by specifying forms of the attaching portion and the bulging edge portion of each reflective tape and by employing reflective yarn as warp or warp knitting yarn of the reflective portion of the bulging edge portion.

It is an object of the invention to provide a slide fastener having an excellent reflecting function by specifying a form of the reflective yarn used in the reflective portion and by using a retroreflective film or a light storage reflective film as material of the reflective yarn.

It is an object of the invention to provide a slide fastener having a reflecting function by specifying a form of the reflective yarn used in the reflective portion and by dyeing a synthetic fiber with fluorescent dye or fluorescent brightener or by applying fluorescent bleaching to the synthetic fiber.

It is an object of the invention to provide a slide fastener having an excellent reflecting function by simultaneously molding the attaching portion and the bulging edge portion of each reflective tape by using thermoplastic resin by integrally molding means, and by forming the reflective portion on the bulging portion.

It is an object of the invention to provide a slide fastener having an excellent reflecting function and wherein the reflective portion on the bulging edge portion of each reflective tape can be formed using simple means by coating the surface of the bulging edge portion with reflective coating after molding of the reflective tape.

It is an object of the invention to provide a slide fastener having an excellent reflecting function and wherein the reflective portion on the bulging edge portion of each reflective tape can be formed extremely easily by mixing reflective material into the bulging edge portion at the time of molding of the bulging edge portion.

To achieve the above objects, according to the first aspect of the invention, there is provided as a main structure a slide fastener comprising reflective tapes provided separately from fastener tapes and each having a band-shaped attaching portion, a bulging edge portion integrally formed on a longitudinal edge portion of the attaching portion, and a reflective portion provided to the bulging edge portion, each the reflective tape being attached to the fastener tape along fastener elements such that at least a distance corresponding to a thickness of a flange of a slider is maintained between the bulging edge portion and a side of the fastener elements and that the reflective portion on the bulging edge portion appears.

Preferably, the bulging edge portion which is formed on the longitudinal edge portion of the band-shaped attaching portion of each reflective tape and has the reflective portion has more rigidity than the attaching portion, protrudes from a surface of the fastener tape with respect to the fastener elements, and is attached to the fastener tape for a swinging movement with respect to the fastener tape.

Further preferably, the band-shaped attaching portion and the bulging edge portion of each reflective tape are woven or knitted by using synthetic fiber yarn, a proper core which is a synthetic fiber is inserted into the bulging edge portion, and a reflective film is woven or knitted into the bulging edge portion to form the reflective portion. Instead of using the reflective film, a reflective yarn may be woven or knitted as a warp or a warp knitting yarn of the bulging edge portion to form the reflective portion.

And preferably, a retroreflective film or a light storage reflective film is woven or knitted as the reflective film into the reflective portion on the bulging edge portion of each reflective tape to form the reflective portion.

Preferably, the reflective yarn for forming the reflective portion formed on the bulging edge portion of each the reflective tape is formed by winding a narrow retroreflective film or a narrow light storage reflective film as the reflective film around the synthetic fiber yarn as a core.

Alternatively, the reflective yarn is formed by dyeing the synthetic fiber yarn with fluorescent dye or fluorescent brightener or by applying fluorescent bleaching to the synthetic fiber yarn.

Preferably, the band-shaped attaching portion and the bulging edge portion of the reflective tape are successively and integrally molded simultaneously by extrusion means or injection molding means by using thermoplastic resin and the reflective portion is formed on the molded bulging edge portion.

Still preferably, the reflective portion formed on the bulging edge portion of the reflective tape is formed by coating a surface of the bulging edge portion with reflective coating to form a reflective coating layer after molding the reflective tape.

Alternatively, the reflective portion formed on the bulging edge portion of the reflective tape is formed by molding the bulging edge portion while mixing reflective material into the bulging edge portion.

DESCRIPTION OF THE PREFERRED EMBODIMENTS

Embodiments of a slide fastener of the invention will be specifically described below by reference to the drawings.

Figure 1:
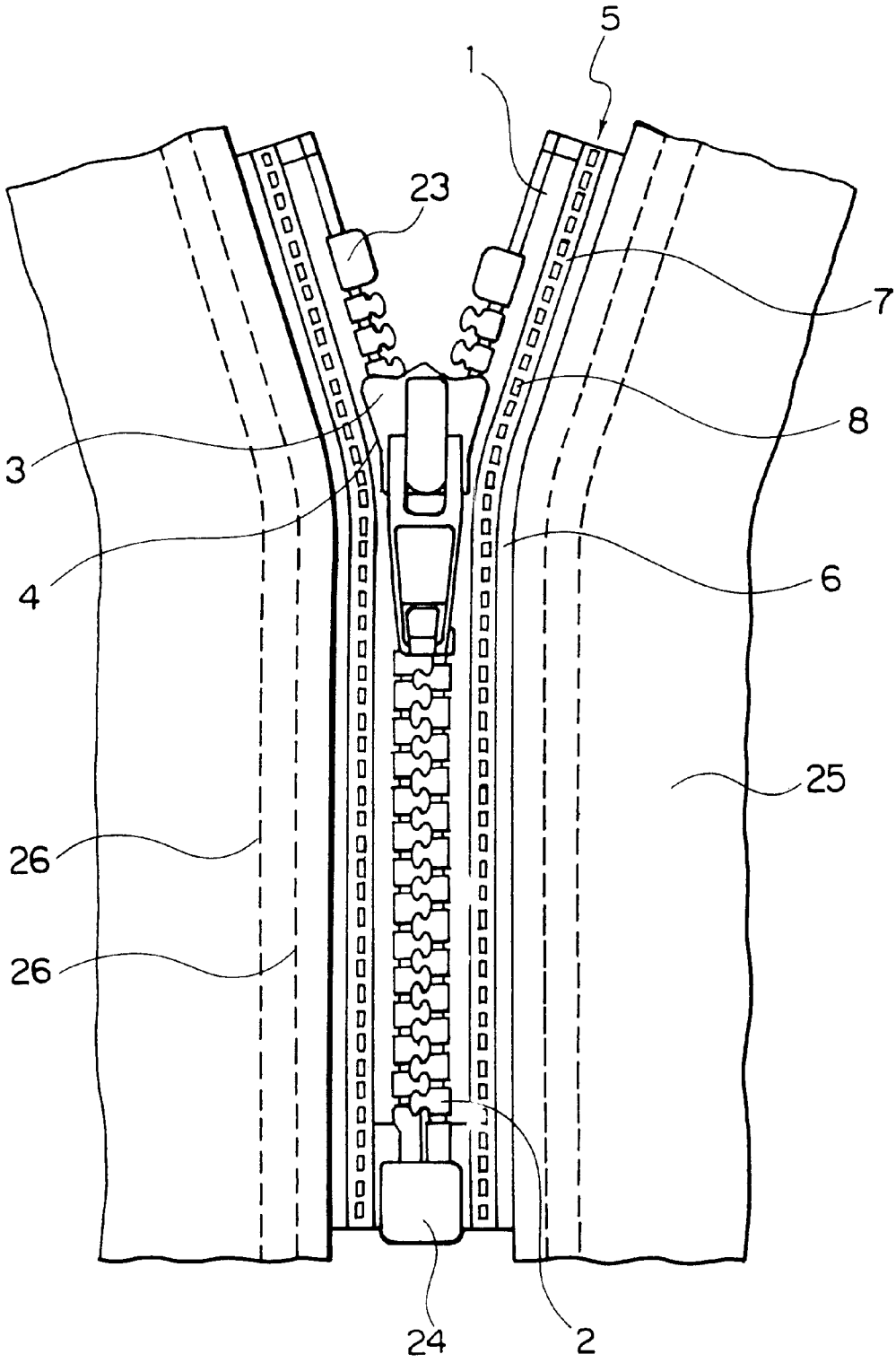
FIG. 1 is a front view of a slide fastener along which reflective tapes are attached.
Figure 2:
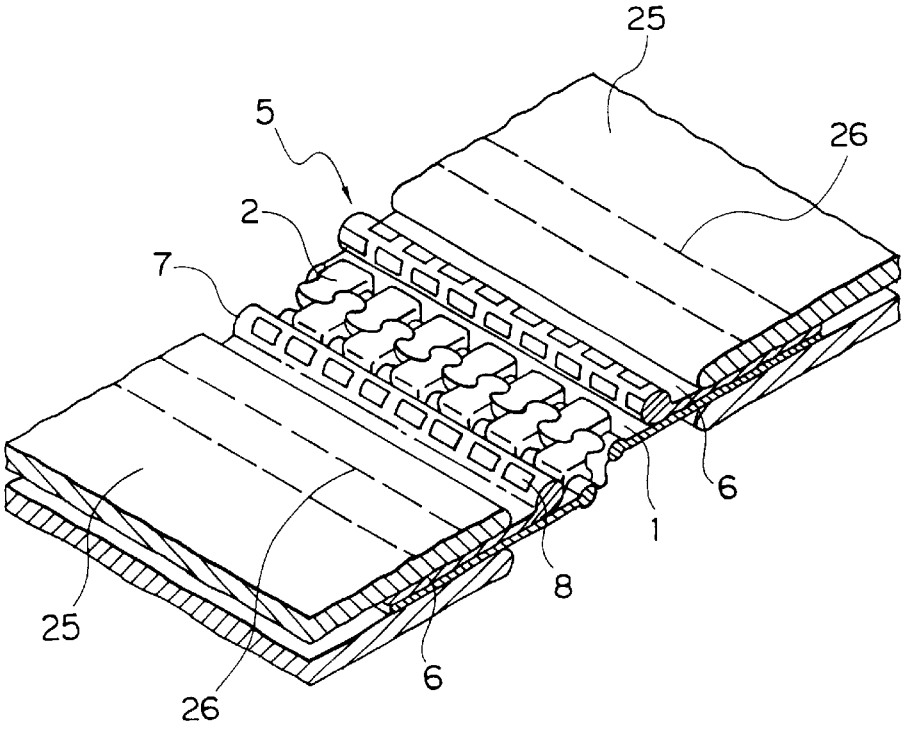
FIG. 2 is a fragmentary sectional perspective view of the slide fastener.

As shown in FIGS. 1 and 2, the slide fastener of the invention comprises reflective tapes 5 which are laid on and attached to faces of fastener tapes 1 of the slide fastener. In each the reflective tape 5, a band-shaped attaching portion 6 at one side for attaching the reflective tape 5 to the fastener tape 1 and a bulging edge portion 7 at the other longitudinal edge of the reflective tape 5 are formed integrally. The bulging edge portion 7 has reflective portions 8 for reflecting light.

Figure 3:
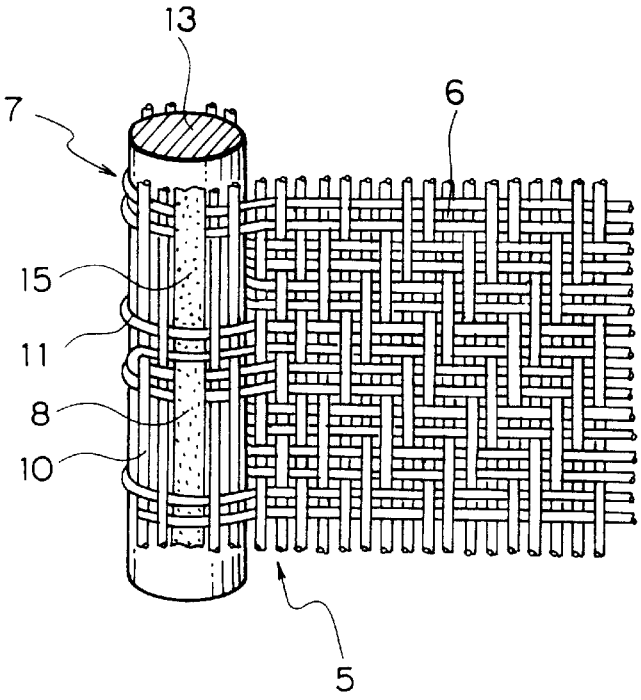
FIG. 3 is a fragmentary enlarged view of a woven reflective tape.

The attaching portion 6 and the bulging edge portion 7 of the reflective tape 5 are formed by weaving warps 10 and wefts 11 which are synthetic fiber yarns of polyamide, polyester, or the like by needle weaving means, and the bulging edge portion 7 is formed by hollow-weaving an edge portion of the reflective tape 5 with a core 13 in a proper form of monofilament or multifilament made of synthetic fiber being inserted into the bulging edge portion 7 on one side of the reflective tape 5 as shown in FIG. 3.

Figure 4:
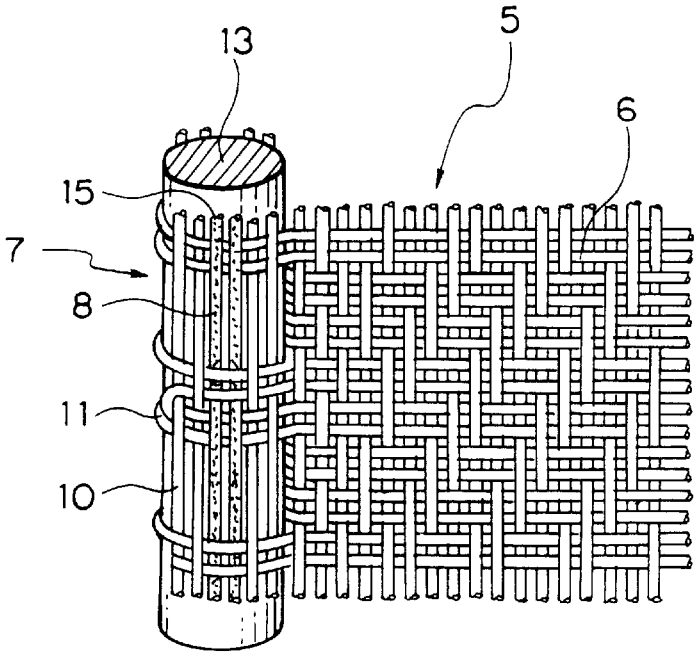
FIG. 4 is a fragmentary enlarged view of another embodiment of a woven reflective tape.

On the bulging edge portion 7, the reflective portions 8 are formed by weaving a plurality of reflective films 15 by every several wefts 11 such that the reflective films 15 are attached along a surface of the core 13 and appear on the core 13, the reflective films 15 being formed by slitting a reflective film into narrow films. It is also possible to weave the plurality of reflective films together on the core 13 as shown in FIG. 4, the reflective films 15 being formed by slitting the reflective film into narrow films.

As the reflective film 15 to be attached along the surface of the core 13, a retroreflective film is used which is formed by evaporating metal such as aluminum, silver, or copper onto a base layer made of polyester resin or by plating or coating the base layer with the metal so as to make a reflective film, forming a layer made of polyvinyl butyral resin and adhesive to glass on the reflective film, and bonding a myriad of glass beads to the adhesive layer.

It is also possible to use a light storage reflective film formed by forming a light storage layer by coating a transparent polycarbonate resin film with $SrAl_2O_4$ or the like as light storage pigment and forming a reflective layer by coating a surface of the light storage layer with ink made by kneading titanium oxide with varnish such as acrylic resin.

Furthermore, it is also possible not to use the reflective films in the bulging edge portion 7 but to form a reflective portion 8 using the reflective yarns 16 which are formed by dyeing the warps 10 which are the synthetic fiber yarns in the hollow-woven portion forming the bulging edge portion 7 with fluorescent dye or fluorescent brightener or applying fluorescent bleaching.

Figure 5:
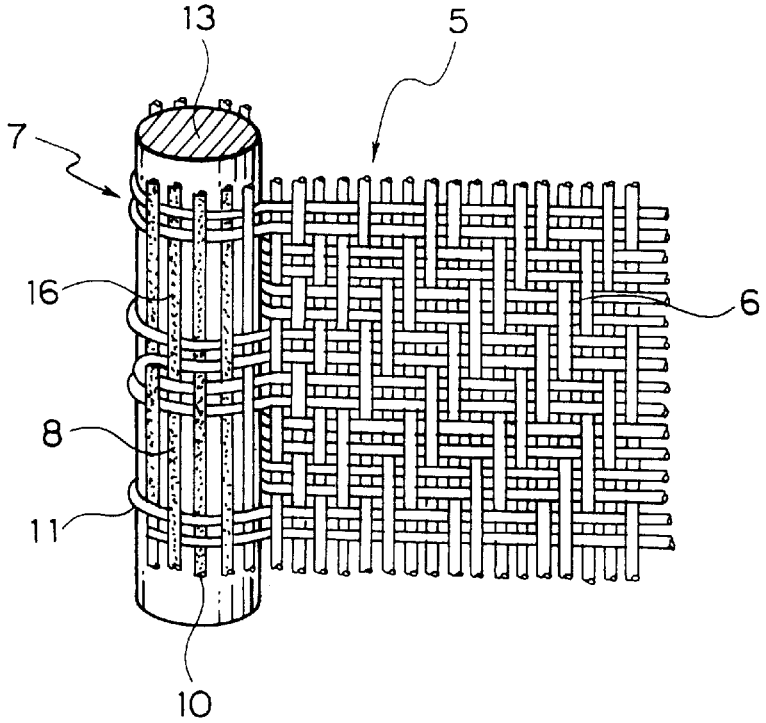
FIG. 5 is a fragmentary enlarged view of yet another embodiment of a woven reflective tape.

In the reflective tape 5 shown in FIG. 5, the reflective portion 8 may be formed by weaving the attaching portion 6 and the bulging edge portion 7 using the warps 10 of the synthetic fiber yarns and the double-picked wefts 11, inserting the core 13 into the hollow-woven portion forming the bulging edge portion 7, and forming the reflective yarns 16 by dyeing the warps 10 disposed on an outer surface of the core 13 with fluorescent dye or fluorescent brightener or by applying fluorescent bleaching, and weaving the reflective yarns 16 as the warps 10.

Figure 6:
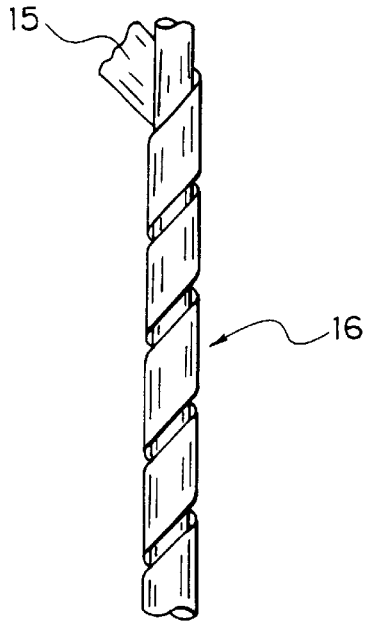
FIG. 6 is a front view of a reflective yarn around which a reflective film is wound.

It is also possible to form the reflective yarn 16 by cutting the reflective film 15 such as a retroreflective film or a light storage reflective film into narrow films and winding the cut long reflective film 15 around the synthetic fiber, and to use the reflective yarns 16 as the warps 10 in the hollow-woven portion or as warp knitting yarns 12 in a hollow-knitted portion forming the bulging edge portion 7 of the reflective tape 5 as shown in FIG. 6.

Figure 7:
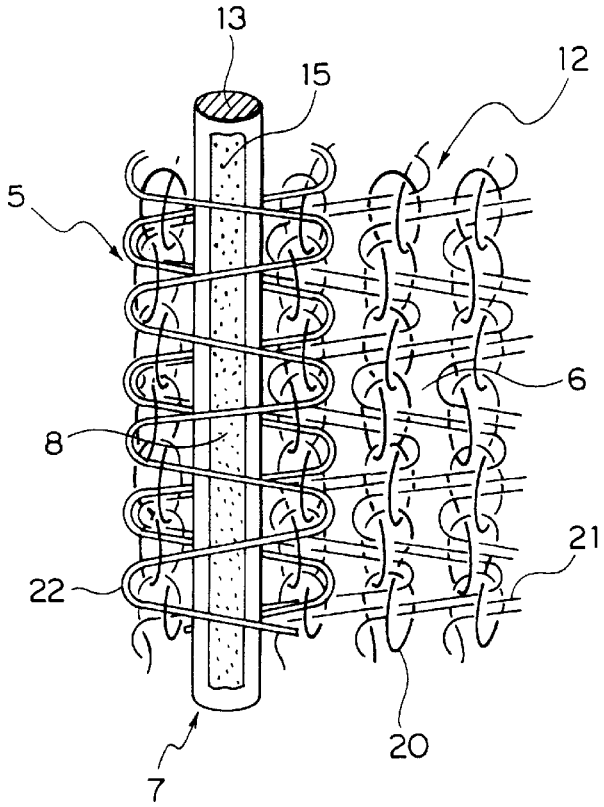
FIG. 7 is a fragmentary enlarged view of a knitted reflective tape.

FIG. 7 shows a reflective tape 5 formed of a warp knitting structure wherein chain stitch yarns 20 of 1-0/0-1 as the warp knitting yarns 12 and weft in-laid yarns 21 of 0-0/3-3 are disposed throughout all wales from $W_1$ to $W_n$ and are intermingled with each other to knit the attaching portion 6, and the reflective portion 8 may be formed by inserting the core 13 which is the synthetic fiber through an opened-up space between the wales $W_1$ and $W_2$, fastening front and rear sides of the core 13 by slightly thick weft in-laid yarn 22 of 0-0/1-0, and attaching the proper reflective film 15 formed by slitting the reflective film along a surface of the core 13 or by winding the reflective film 15 formed by slitting the reflective film around the core 13 as a core. The warp knitting yarns 12 may be knitted by not only the above-described knitting yarns but also various knitting yarns such as tricot knitting yarns, two needle stitch yarns, warp in-laid yarns, and the like.

Figure 8:
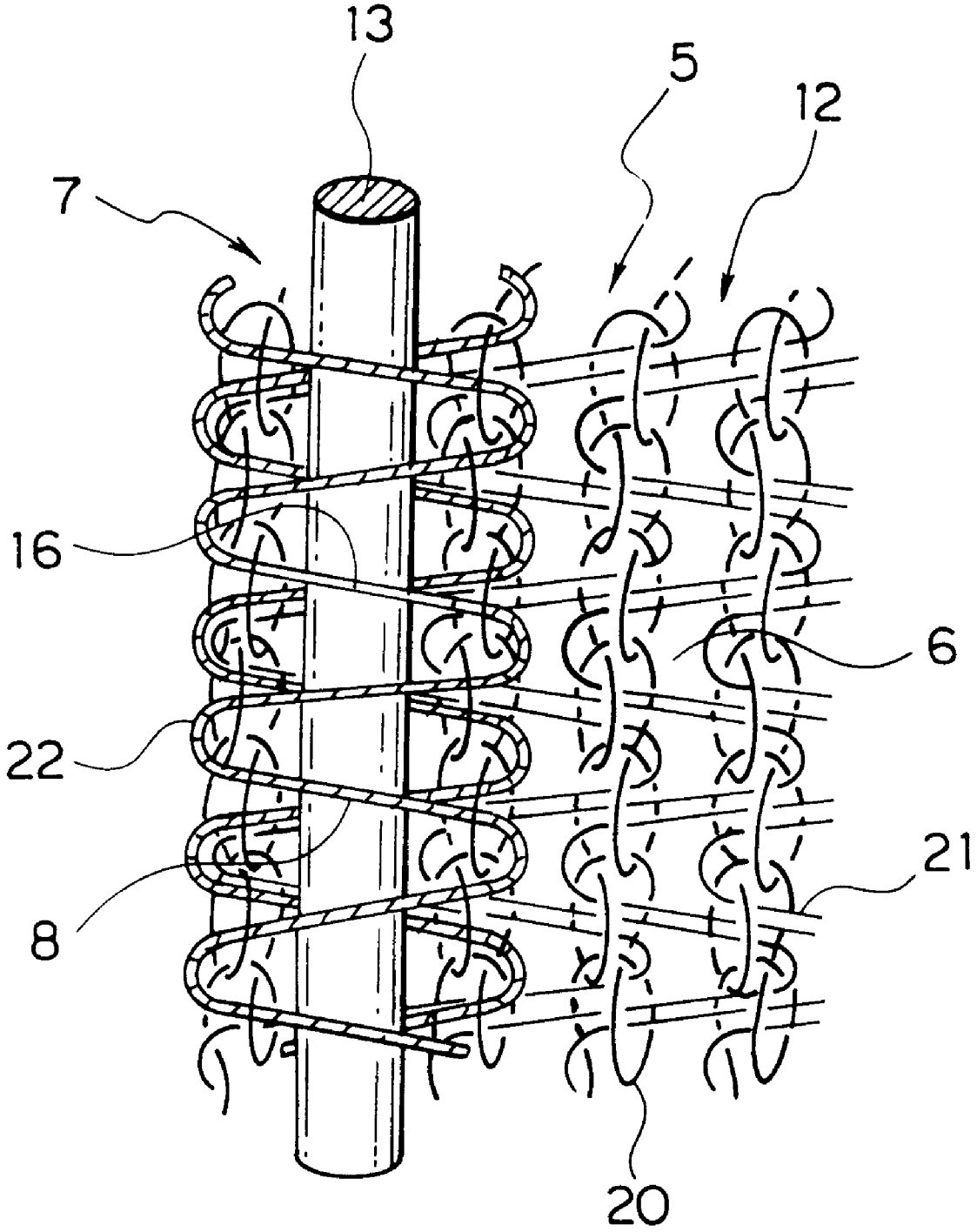
FIG. 8 is a fragmentary enlarged view of another embodiment of a knitted reflective tape.

A warp knitting structure of a reflective tape 5 shown in FIG. 8 is similar to the warp knitting structure in FIG. 5. It is also possible to form the reflective portion 8 by knitting the reflective yarns 16 prepared by dyeing the slightly thick weft in-laid yarn 22 of 0-0/1-1, which is the synthetic fiber yarn and which fastens the front and rear sides of the core 13 with fluorescent dye or fluorescent brightener or by being applied with fluorescent bleaching.

When the reflective portion 8 is formed by using the reflective yarn 16 as the weft in-laid yarn 22 and attaching the reflective film 15 formed by slitting the reflective film along the surface of the core 13 or winding the slit reflective film 15 around the core 13, a reflecting function can be improved.

Figure 9:
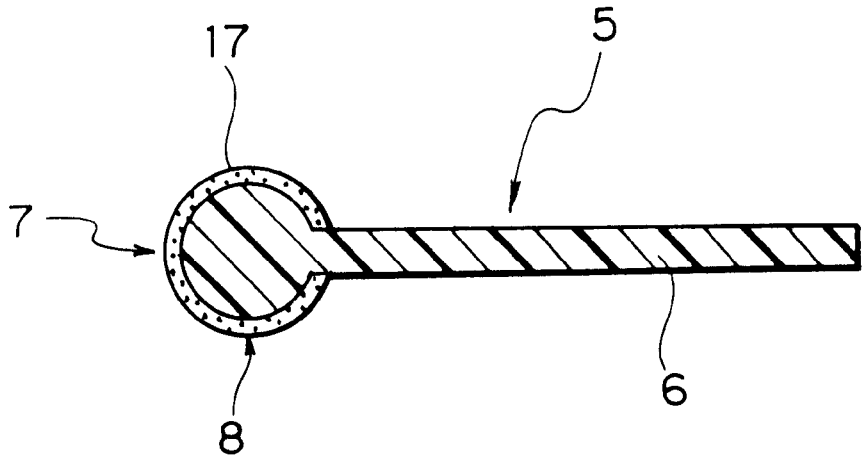
FIG. 9 is a cross sectional view of a molded reflective tape.

Next, in a reflective tape 5 shown in FIG. 9, after successively and integrally molding the attaching portion 6 and the bulging edge portion 7 simultaneously by extrusion means or injection molding means, using thermoplastic resin such as polyamide, a reflective coating layer 17 is formed by coating a surface of the bulging edge portion 7 with retroreflective coating including glass beads and synthetic resin enamel such as polyamide, polyester, epoxy resin, and the like, so as to form the reflective portion 8 on the surface of the bulging edge portion 7.

Figure 10:
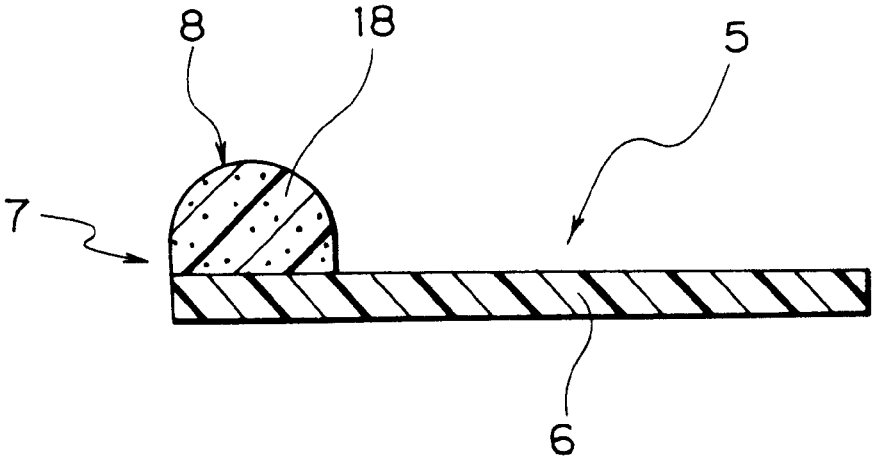
FIG. 10 is a cross-sectional view of another embodiment of a molded reflective tape.

A reflective tape 5 shown in FIG. 10 is similar to the embodiment shown in FIG. 9 in that the attaching portion 6 and the bulging edge portion 7 are successively and integrally molded by extrusion means or injection molding means by using thermoplastic resin such as polyamide, polyester, and the like. In the reflective tape 5 shown in FIG. 10, however, the attaching portion 6 and the bulging edge portion 7 are molded by extruding thermoplastic resin from separate extrusion dies or nozzles, and the bulging edge portion 7 is molded integrally with the attaching portion 6 by using the thermoplastic resin including reflective material 18, e.g., glass beads and shredded reflective film 15 such as a retroreflective film and a light storage reflective film to form the reflective portion 8 at the bulging edge portion 7.

In any of the above-described embodiments, the reflective tape 5 comprises the band-shaped attaching portion 6 and the bulging edge portion 7, the bulging edge portion 7 having the proper reflective portion 8. In the slide fastener, the reflective tape 5 is laid on and attached to the fastener tape 1 such that the bulging edge portion 7 is attached along the fastener elements 2, and that at least a distance corresponding to a thickness of a flange 4 of a slider 3 is maintained between the fastener element 2 and the bulging edge portion 7, and the attaching portion 6 is attached to the fastener tape 1 and to a product for which the slide fastener is used such that the bulging edge portion 7 protrudes upward from a face of the fastener tape 1 and that the bulging edge portion 7 can swing, thereby allowing the reflective portion 8 of the bulging edge portion 7 to exhibit three-dimensional reflecting effects in any directions when illuminated at night.

In the drawings, a reference numeral 23 designates upper end stop of the slide fastener and a reference numeral 24 designates a separable end stop. A reference numeral 25 designates a product for and to which the slide fastener is used and attached and reference numerals 26 designate sewing yarns for attaching the fastener tapes 1 and the reflective tapes 5 to the product.

The slide fastener of the invention has the above-described structures and exhibits the following effects by the structures.

According to the invention, each of the reflective tapes 5 has the band-shaped attaching portion 6, the bulging edge portion 7 integrally formed on the longitudinal edge portion of the attaching portion 6, and the reflective portion 8 provided to the bulging edge portion 7 and each the reflective tape 5 is attached to the fastener tape 5 beside the fastener elements 2 such that at least the distance corresponding to the thickness of the flange 4 of the slider 3 is maintained between the bulging edge portion 7 and the fastener elements 2 and that the reflective portion 8 appears. Therefore, the slide fastener can be easily applied to any types of slide fasteners and it is possible to easily produce the slide fastener having the three-dimensional reflecting function on the fastener tapes 1. Moreover, because the reflective portions are 8 not damaged by the sliding movement of the slider 3, the reflective portions 8 can exhibit excellent reflecting functions for the long term.

According to the invention, the bulging edge portion 7 which is formed on the longitudinal edge portion of the attaching portion 6 of each the reflective tape 5 and has the reflective portion 8 has more rigidity than the attaching portion 6, protrudes from the surface of the fastener tape 1 with respect to the fastener element, and is attached to the fastener tape 1 for a swinging movement with respect to the fastener tape 1. Therefore, the reflective portion 8 is rigid, can be recognized from any directions, and can properly exhibit the reflecting function.

According to the invention, the attaching portion 6 and the bulging edge portion 7 of each reflective tape 5 are woven or knitted using synthetic fiber yarn, the core 13 made of thermoplastic resin is inserted into the bulging edge portion 7, and the reflective film 15 is woven or knitted into the bulging edge portion to 7 form the reflective portion 8. Therefore, the reflective tape 5 can be produced by simple structure and means and the reflective portion 8 can be easily produced by employing the reflective film 15.

According to the invention, the retroreflective film or the light storage reflective film is woven or knitted as the reflective film 15 into the reflective portion 8 formed on the bulging edge portion 7 to form the reflective portion 8. Therefore, it is possible to use the retroreflective film and the light storage reflective film which are made of simple material for the reflective portion 8 by simple means and the reflective portion 8 can exhibit the excellent reflecting function.

According to the invention, the attaching portion 6 and the bulging edge portion 7 of each reflective tape 5 are woven or knitted using synthetic fiber yarn, the core 13 made of thermoplastic resin is inserted into the bulging edge portion 7, and reflective yarn 16 is woven or knitted as warp or warp knitting yarn of the bulging edge portion 7 to form the reflective portion 8. Therefore, the reflective tape 5 can be produced by simple structure and means and the reflective portion 8 can be easily produced by employing the reflective yarn 16.

According to the invention, the reflective yarn 16 for forming the reflective portion 8 is formed by winding the narrow retroreflective film or the narrow light storage reflective film as the reflective film 15 around the synthetic fiber yarn. Therefore, it is possible to employ the retroreflective film and the light storage reflective film as the reflective yarn 16 by simple means to form the reflective portion 8 and the reflective portion 8 can exhibit the excellent reflecting function.

According to the invention, the reflective yarn 16 for forming the reflective portion 8 is formed by dyeing the synthetic fiber yarn with fluorescent dye or fluorescent brightener or by applying fluorescent bleaching to the synthetic fiber yarn. Therefore, it is possible to easily employ dyeing means and fluorescent brightening means for the reflective yarn 16 by using fluorescent dye and fluorescent brightener, the reflective portion 8 can be produced easily, and the reflective portion 8 can exhibit the excellent reflecting function.

According to the invention, the attaching portion 6 and the bulging edge portion 7 of each reflective tape 5 are successively and integrally molded by extrusion or injection molding using thermoplastic resin and the reflective portion 8 is formed on the bulging edge portion 7. Therefore, it is possible to employ thermoplastic resin for the reflective tapes 5. Because the reflective tapes 5 can be produced at a single stroke by simple molding means, the productivity can be improved.

According to the invention, the reflective portion 8 formed on the bulging edge portion 7 of each reflective tape 5 is formed by coating the surface of the bulging edge portion 7 with reflective coating to form the reflective coating layer 17. Therefore, it is possible to easily form the reflective portion 8 after molding the bulging edge portion 7 by molding means and to give the excellent reflecting function to the reflective portion 8.

According to the invention, the reflective portion 8 formed on the bulging edge portion 7 of each reflective tape 5 is formed by molding the bulging edge portion 7 while mixing reflective material 18 into the bulging edge portion 7. Therefore, it is possible to easily form the reflective portion 8 in molding the bulging edge portion 7 by molding means and to give the excellent reflecting function to the reflective portion 8.

What is claimed:

1. A slide fastener comprising reflective tapes each having a band-shaped attaching portion, a bulging edge portion integrally formed on a longitudinal edge portion of said attaching portion, and a reflective portion provided to said bulging edge portion, each said reflective tape being attached to a fastener tape along fastener elements such that at least a distance corresponding to a thickness of a flange of a slider is maintained between said bulging edge portion and said fastener elements and that said reflective portion appears.

2. A slide fastener according to claim 1, wherein said bulging edge portion which is formed on said longitudinal edge portion of said attaching portion of each said reflective tape and has said reflective portion has more rigidity than said attaching portion, protrudes from a surface of said fastener tape with respect to said fastener elements, and is attached to said fastener tape for a swinging movement with respect to the fastener tape.

3. A slide fastener according to claim 1, wherein said attaching portion and said bulging edge portion of each said reflective tape are woven or knitted by using synthetic fiber yarn, a core which is a synthetic fiber is inserted into said bulging edge portion, and a reflective film is woven or knitted into said bulging edge portion to form said reflective portion.

4. A slide fastener according to claim 3, wherein a retroreflective film or a light storage reflective film is woven or knitted as said reflective film into said reflective portion on said bulging edge portion to form said reflective portion.

5. A slide fastener according to claim 1, wherein said attaching portion and said bulging edge portion of each said reflective tape are woven or knitted by using synthetic fiber yarn, a core which is a synthetic fiber is inserted into said bulging edge portion, and a reflective yarn is woven or knitted as a warp or a warp knitting yarn of said bulging edge portion to form said reflective portion.

6. A slide fastener according to claim 5, wherein said a reflective yarn for forming said reflective portion is formed by winding a narrow retroreflective film or a narrow light storage reflective film as said reflective film around said synthetic fiber yarn.

7. A slide fastener according to claim 5, wherein said reflective yarn for forming said reflective portion is formed by dyeing said synthetic fiber yarn with fluorescent dye or fluorescent brightener or by applying fluorescent bleaching to said synthetic fiber yarn.

8. A slide fastener according to claim 1, wherein said attaching portion and said bulging edge portion of each said reflective tape are successively and integrally molded by extrusion or injection molding using thermoplastic resin and said reflective portion is formed on said bulging edge portion.

9. A slide fastener according to claim 8, wherein said reflective portion formed on said bulging edge portion of each said reflective tape is formed by coating a surface of said bulging edge portion with reflective coating to form a reflective coating layer.

10. A slide fastener according to claim 8, wherein said reflective portion formed on said bulging edge portion of each said reflective tape is formed by molding said bulging edge portion while mixing reflective material into said bulging edge portion.

* * * * *